US009591899B2

(12) United States Patent
Catanese

(10) Patent No.: US 9,591,899 B2
(45) Date of Patent: Mar. 14, 2017

(54) CLASP FOR A BRACELET OR BELT

(71) Applicant: OMEGA S.A., Biel/Bienne (CH)

(72) Inventor: Rocco Catanese, Bienne (CH)

(73) Assignee: Omega S.A., Biel/Bienne (CH)

( * ) Notice: Subject to any disclaimer, the term of this patent is extended or adjusted under 35 U.S.C. 154(b) by 0 days.

(21) Appl. No.: 14/741,875

(22) Filed: Jun. 17, 2015

(65) Prior Publication Data

US 2016/0081439 A1 Mar. 24, 2016

(30) Foreign Application Priority Data

Sep. 19, 2014 (EP) ..... 14185629

(51) Int. Cl.
*A44C 5/24* (2006.01)
*A44B 11/22* (2006.01)
*A44C 5/20* (2006.01)

(52) U.S. Cl.
CPC ..... *A44C 5/246* (2013.01); *A44B 11/226* (2013.01); *A44C 5/2042* (2013.01); *Y10T 24/2155* (2015.01); *Y10T 24/4782* (2015.01)

(58) Field of Classification Search
CPC ..... A44C 5/246; A44C 5/2042; A44C 5/22; A44C 5/24; A44C 5/243; A44C 5/00; A44C 5/18; A44C 11/226; Y10T 24/2155; Y10T 24/2166; Y10T 24/4782
See application file for complete search history.

(56) References Cited

U.S. PATENT DOCUMENTS 1,741,421 A * 12/1929 Kraemer ..... A44C 5/24 24/71 J
3,665,564 A * 5/1972 Oka ..... A44C 5/24 24/265 WS
3,797,716 A * 3/1974 Mochizuki ..... A44C 5/24 224/176
4,545,095 A * 10/1985 Fontana ..... A44C 5/24 24/265 WS (Continued)

FOREIGN PATENT DOCUMENTS

CH 700 230 A2 7/2010
CH 702 523 A2 7/2011

(Continued)

OTHER PUBLICATIONS

European Search Report issued Mar. 4, 2015 in European Application 14185629, Sep. 19, 2014 ( with English Translation).

*Primary Examiner* — Abigail Morrell
(74) *Attorney, Agent, or Firm* — Oblon, McClelland, Maier & Neustadt, L.L.P.

(57) ABSTRACT

A bracelet clasp including a securing member provided with an adjustment device for adjusting the useful length of the bracelet, this adjustment device including a base plate secured to the second end of the first strip, a cap pivotally hinged to the base plate, the first strand passing between the base plate and the cap and being held by a holding device, second device for locking the cap in the closed position on the base plate. The second locking device include a push-piece arranged to be moved between a first rest position in which the cap is locked in a closed position on the base plate, and a second pushed-in position in which the cap is unlocked from the base plate.

20 Claims, 2 Drawing Sheets

(56) References Cited

U.S. PATENT DOCUMENTS

| | | | | | |
|---|---|---|---|---|---|
| 5,485,659 | A | * | 1/1996 | Kashikie | A44C 5/2052<br>24/265 WS |
| 5,787,554 | A | * | 8/1998 | Hashimoto | A44C 5/185<br>24/265 WS |
| 5,829,104 | A | * | 11/1998 | Gay | A44C 5/24<br>24/265 WS |

FOREIGN PATENT DOCUMENTS

| | | |
|---|---|---|
| DE | 61468 | 3/1892 |
| EP | 1 943 917 A2 | 7/2008 |

* cited by examiner

Fig. 3B
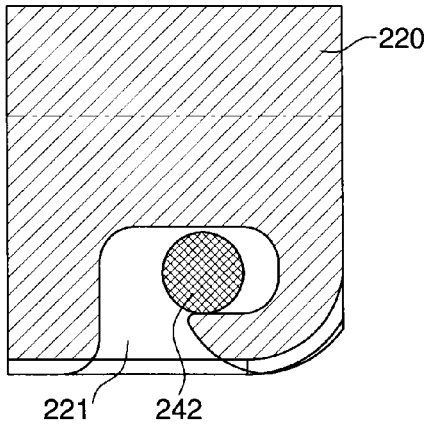
Fig. 3A
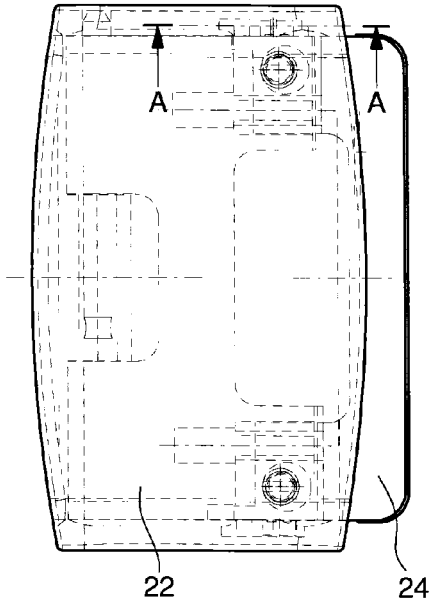
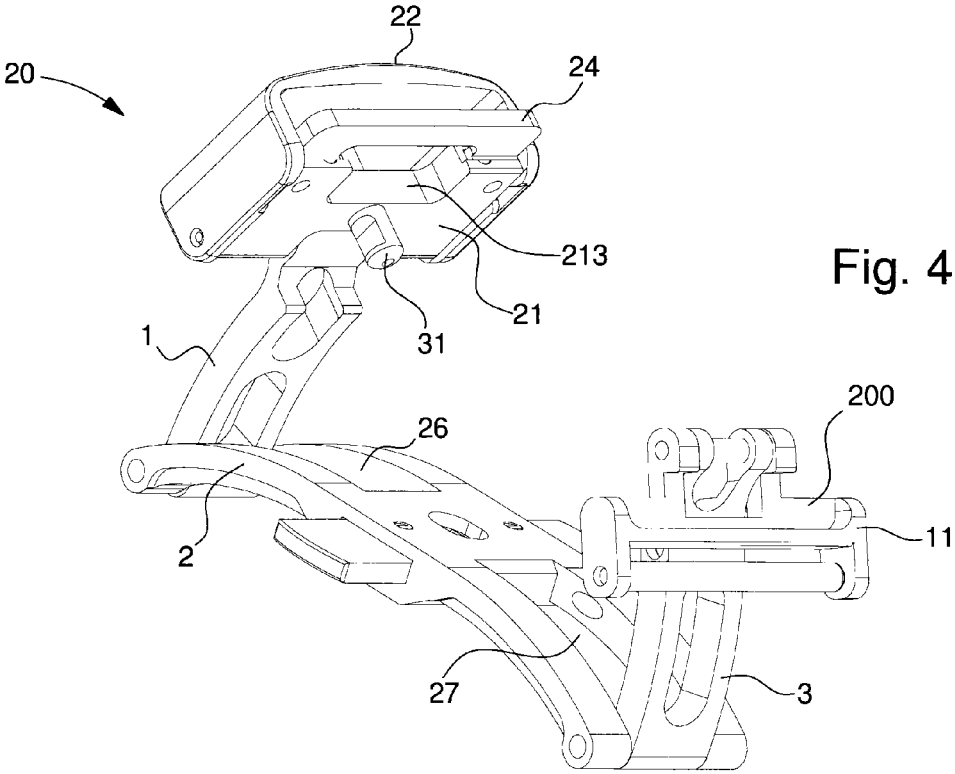
Fig. 4

CLASP FOR A BRACELET OR BELT

FIELD OF THE INVENTION

The invention relates to a clasp for a bracelet with an adjustable strand, and in particular for watch bracelets or straps.

BACKGROUND OF THE INVENTION

There is known from EP Patent No 0607726 a bracelet clasp having a mechanism including a base plate hinged to the end of a strip, and a cap in the form of an inverted U projecting over the base plate and the two free edges of which are respectively extended on the same side by a lateral arm, the end of which is rotatably mounted on the corresponding lateral face of the base plate. The free edges of the cap can be locked by lateral locking means, the adjustable strand passes between the base plate and the cap, and is retained by a stud protruding from the inner face of the base plate or of the cap.

It is not easy for a user to operate such a mechanism since it is necessary to unlock the mechanism using a nail in order to adjust the length of the strand, and to hold the base plate when it is desired to change the length of the bracelet strand. Furthermore, the locking of the mechanism is not entirely secure, since the cap may be unlocked if it becomes caught or if there is a shock when the bracelet is worn.

SUMMARY OF THE INVENTION

It is an object of the invention to overcome the various drawbacks of these known techniques.

More specifically, it is an object of the invention to provide a clasp permitting the length of a bracelet strand to be adjusted simply and quickly.

It is also an object of the invention, at least in a particular embodiment, to provide a clasp that is simple to implement and inexpensive.

These objects, in addition to others that will appear more clearly below, are achieved by the invention with the aid of a bracelet clasp of the type with a deployment buckle, including at least first and second strips, the first strip being hinged to the second strip by a first end, between a closed position, called the wearing position, in which the first strip is folded onto the second strip, and an open position in which the first strip is distant from the second strip, the first strip carrying, at a second end, a member for securing a first bracelet strand, a second bracelet strand being connected at least indirectly to the second strip, the first strip including first locking means able to hold the first strip in the closed position.

The securing member includes means for adjusting the useful length of the bracelet, these adjustment means including:

- a base plate secured to the second end of the first strip,
- a cap pivotally hinged to the base plate, the first strand passing between the base plate and the cap and being held by holding means,
- second means for locking the cap in the closed position on the base plate.

According to the invention, the second locking means include a push-piece arranged to be moved in a longitudinal direction of the bracelet, in response to an action of the user, between a first rest position in which the cap is locked in a closed position on the base plate, and a second pushed-in position in which the cap is unlocked from the base plate.

In accordance with other advantageous variants of the invention:

- the cap has an L-shaped groove on the inner face of each of its lateral walls, in proximity to one of its ends;
- the push-piece includes a slug on each of its edges, each slug being configured to cooperate with the corresponding L-shaped groove;
- the second locking means include return means configured to cooperate with the push-piece to hold the push-piece in a closed position;
- the return means include at least one spring;
- the base plate includes means for guiding the push-piece;
- the return means rest in said push-piece guide means;
- the base plate has a stud on its upper face, called the upper stud, intended to be inserted in a suitable hole of the bracelet strand to define an anchoring point;
- the first strand is inserted through the adjustment means, where the cap is hinged on the base plate.

The invention also concerns a wristwatch including a bracelet provided with a clasp according to the invention.

The invention also concerns a module for securing a strand to a fastener including a securing member provided with means for adjusting the useful length of the strand, these adjustment means including:

- a base plate,
- a cap pivotally hinged to the base plate, the strand passes between the base plate and the cap and is held by holding means,
- second means for locking the cap on the base plate in the closed position are provided in said base plate,
- the second locking means include a push-piece arranged to be moved in a longitudinal direction of the bracelet, in response to an action of the user, between a first rest position in which the cap is locked in the closed position on the base plate, and a second pushed-in position in which the cap is unlocked from the base plate.

Thus, by means of the various functional and structural aspects described above, the present invention makes it possible to obtain a clasp wherein the useful length of a strand can be adjusted in a particularly easy and rapid manner.

BRIEF DESCRIPTION OF THE DRAWINGS

Other characteristics and advantages of the invention will appear more clearly upon reading the following description of a specific embodiment of the invention, given simply by way of illustrative and non-limiting example, and the annexed Figures, among which:

FIG. 3A is a top view of the second clasp locking means according to the invention.

FIG. 3B is a cross-sectional view along the line AA of FIG. 3A of the second clasp locking means according to the invention.

FIG. 4 is a perspective view of a clasp according to another embodiment of the invention.

DETAILED DESCRIPTION OF PREFERRED EMBODIMENTS

Figure 1:
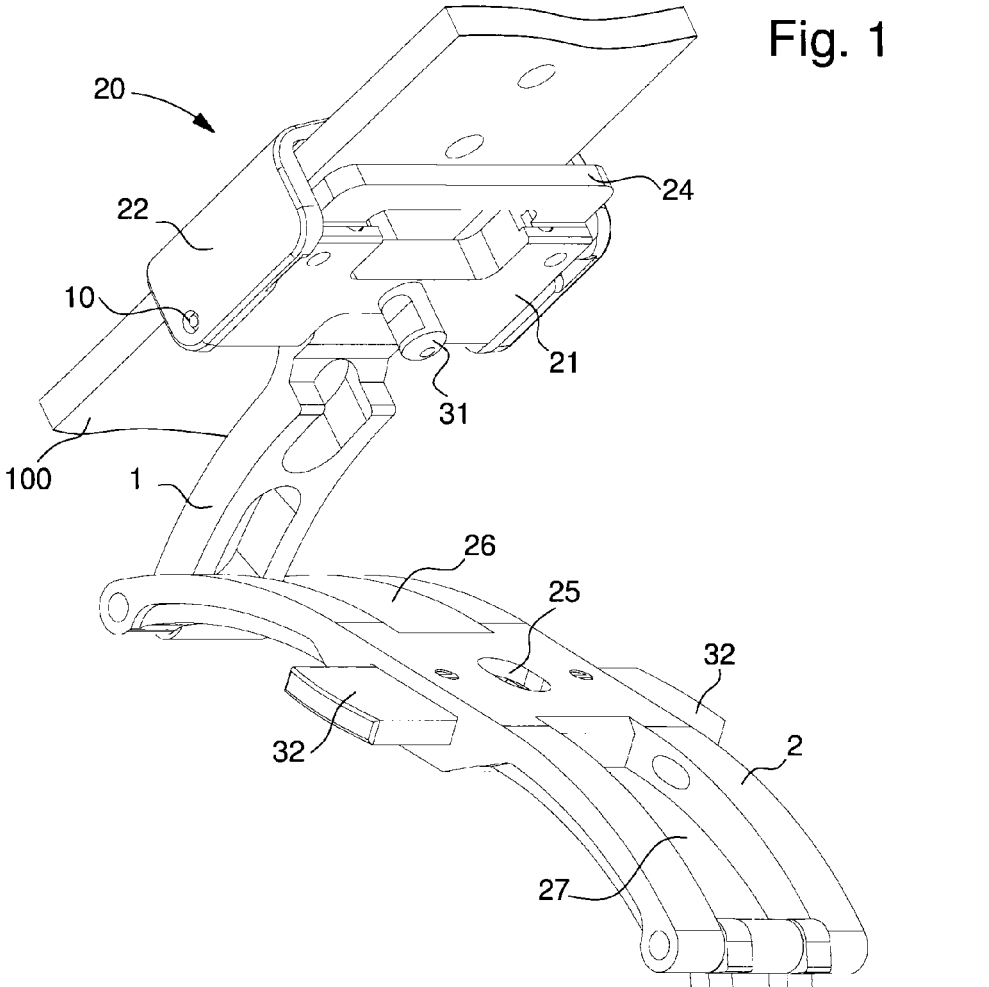
FIG. 1 is a perspective view of a clasp according to the invention.

A bracelet clasp with an adjustable strand according to a first example embodiment will now be described below with reference jointly to FIGS. 1, 2, 3A and 3B.

According to a first embodiment, the invention concerns a bracelet clasp, of the type with a deployant buckle, including at least first and second strips, the first strip 1 being hinged to the second strip 2 by a first end, between a closed position, called the wearing position, in which the first strip 1 is folded onto the second strip 2, and an open position, in which the first strip 1 is distant from the second strip 2.

First strip 1 carries, at a second end, a member 20 for securing a first bracelet strand 100, a second bracelet strand 101 being at least indirectly connected to second strip 2 by means of an attachment link 11 for example, first strip 1 including first locking means capable of holding first strip 1 in its closed position.

Strands 100, 101 may be manufactured in materials such as leather, fabric, canvas, or any other material known to those skilled in the art for producing bracelets or belts.

The first locking means may be formed, for example, by at least one spring catch 32 configured to hold and/or release a stud, called the lower stud 31, so as to hold first strip 1 in its closed position against second strip 2 or to release first strip 1 into its distant position.

Second strip 2 may, for example, have a through orifice at the centre thereof, called the central orifice 25, the central orifice being configured to receive lower stud 31 so that lower stud 31 cooperates with the spring catch. Of course, other locking means could have been envisaged by those skilled in the art within the scope of the present invention.

Figure 2:
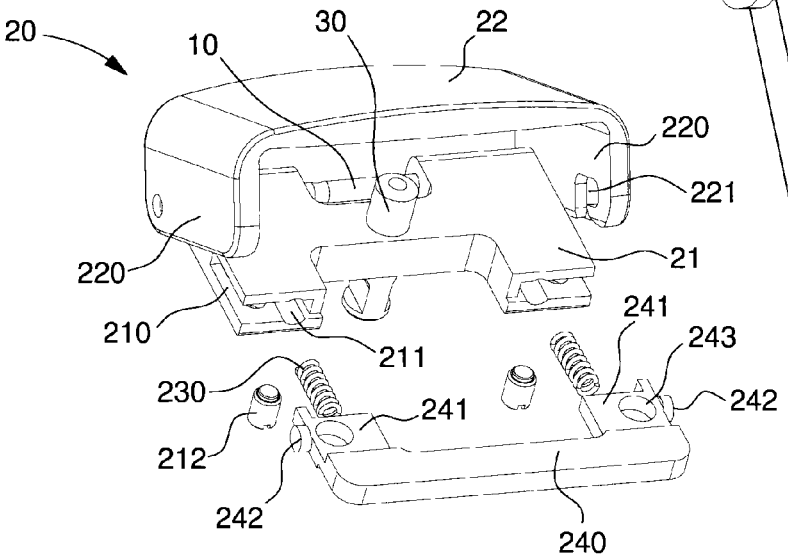
FIG. 2 is an exploded view of second means for locking a clasp according to the invention.

As can be observed in FIGS. 1 and 2, securing member 20 includes means for adjusting the useful length of the bracelet, these adjustment means include:

- a base plate 21 pivotally hinged to the second end of first strip 1, the base plate being held by a bar 10, and
- an inverted U-shaped cap 22, pivotally hinged to base plate 21, cap 22 being held to base plate 21 via its lateral edges by means of bar 10.

This arrangement of base plate 21 and cap 22 makes it possible for first strand 100 to pass between base plate 11 and cap 22. Advantageously, first strand 100 passes through the adjustment means, where the cap is hinged to the base plate. As can be observed in the Figures, first strand 100 is held in its position via holding means such as a stud, called upper stud 30, intended to be inserted into a suitable hole of first strand 100 to define a point of anchoring of the latter to the clasp. Of course, other holding means could have been envisaged by those skilled in the art within the scope of the present invention.

The adjustment means also include second locking means for holding cap 22 in the closed position on base plate 21.

Advantageously, the second locking means are formed by a push-piece 24 arranged to be moved in a longitudinal direction of first strand 100, in response to an action of the user, between a first rest position in which cap 22 is locked in the closed position on base plate 21, and a second pushed-in position in which cap 22 is unlocked from base plate 21.

As shown in FIG. 2, the second locking means include return means, such as springs 230, configured to exert a force on push-piece 24 so as to hold push-piece 24 in the closed position.

Base plate 21 includes guide means for push-piece 24 and springs 230, the guide means respectively taking the form of a guide slot 210 on either side of base plate 21 for push-piece 24 and of a guide cylinder 211 for each spring 230, springs 230 thus being laterally held in guide cylinder 211.

Advantageously, guide slots 210 are arranged to be through slots, so that push-piece 24 can cooperate with the lateral walls of cap 22.

Push-piece 24 is formed by a body, 240, of equivalent width to the width of base plate 21, and has an arm 241 arranged at each of end thereof, arms 241 being configured to slide inside guide slots 210 and to cooperate in abutment with springs 230. As can be observed in the Figures, each arm 241 of push-piece 24 includes a slug 242 oriented towards the exterior of guide slot 210 to cooperate with one of lateral walls 220 of cap 22.

The push-piece also has a through hole 243 in each arm 241, each of through holes 243 being configured to allow a screw 212, fixed to base plate 21, to pass through and thus to hold push-piece 24 in place when it is stressed by springs 230. Through holes 243 have a large diameter than those of screws 212, the difference between the diameters of hole 243 and of screw 212 defining the length of travel of push-piece 24.

According to the invention, cap 22 has an L-shaped groove 221 on the inner face of each of its lateral walls 220, preferably disposed in proximity to an end thereof, each L-shaped groove 221 being configured to cooperate with a respective slug 242 of push-piece 24.

According to a variant embodiment that is not shown in the Figures, cap 22 includes a slug on the inner face of each of its lateral walls 220, and each arm 241 of push-piece 24 includes a groove configured to cooperate with a respective slug of cap 22. Thus, when a user presses push-piece 24, the grooves move and release the slugs present on lateral walls 220 of cap 22.

As can be observed in FIG. 3A, when cap 22 is in a closed position, springs 230 constrain push-piece 24 so that body 240 of push-piece 24 projects slightly from cap 22 and slugs 242 remain in place at the bottom of L-shaped grooves 221. To release cap 22, the user presses push-piece 24 so that slugs 242 are stopped in the "foot" of the L of each L-shaped groove 221. The user can then raise cap 22 and release first strand 100 by lifting the latter so as to extract the upper stud from first strand 100.

According to a particularly advantageous aspect of the invention, the user can use the same finger to press push-piece 24 and raise cap 22, with the finger coming into immediate proximity to cap 22 once the push-piece is in the pushed-in position.

According to a second embodiment of the invention, the bracelet clasp, of the deployment buckle type, includes first, second and third strips, the first strip 1 being hinged to the second strip 2 by a first end, and the third strip 3 being hinged to second strip 2 by the second end, opposite the first end.

First strip 1 and third strip 3 can change from a closed position, called the wearing position, in which first strip 1 and third strip 3 are folded onto second strip 2, to an open position in which first strip 1 and third strip 3 are distant from second strip 2.

First strip 1 carries, at a second end, a member 20 for securing a first bracelet strand 100, a second bracelet strand 101 being at least indirectly connected to second strip 2, first strip 1 including first locking means 10 capable of holding first strip 1 in its closed position.

As can be observed in FIG. 4, securing member 20 includes identical means of adjusting the length of first strand 100 to those present in the first embodiment, and consequently these adjustment means will not be described again.

As can be observed in FIG. 4, second strip 2 includes two longitudinal recesses 26 and 27 disposed symmetrically on either side of central orifice 25. Advantageously, longitudinal recesses 26 and 27 are respectively of complementary shape to first strip 1 and third strip 3.

Thus, first strip 1 and third strip 3 rest at least partially in longitudinal housings 26 and 27, so that the second end of first strip 1 and of third strip 3 rests on second strip 2 in immediate proximity to central orifice 25.

As illustrated in FIG. 4, base plate 21 has a hollow 213 in the end receiving push-piece 24 so as to form a housing, between base plate 21 and push-piece 24, which is configured to receive the second end of third strip 3 when first strip 1 and third strip 3 are in a closed position.

According to this particular embodiment of the invention, attachment link 11 has a receptacle 200 in which body 240 of push-piece 24 is housed when first strip 1 and third strip 3 are folded onto second strip 2 in the closed position.

To close the clasp, the user first folds third strip 3 onto second strip 2 in the corresponding longitudinal recess 27, so that the second end of third strip 3 is positioned above central orifice 25. Next, the user folds first strip 1 onto second strip 2 in the corresponding longitudinal recess 26, so that the second end of first strip 1 is positioned above central orifice 25, and so that the second end of third strip 3 rests in hollow 213. Finally, strips 1 and 3, are locked once the user positions lower stud 31 in central orifice 25 and locks the stud by means of the first locking means.

The invention also concerns a wristwatch including a bracelet provided with a clasp as previously described.

The invention also concerns a module for securing a strand to a fastener, such as a belt fastener for example, the securing module being provided with means for adjusting the length of the strand, these adjustment means including:

a base plate 21 secured to the second end of first strip 1 and a cap 22 pivotally hinged to base plate 21, the strand passing between base plate 21 and cap 22, and the strand being held by means of holding means disposed on the upper face and on the lower face of base plate 211, and second means for locking cap 22 on base plate 21 in the closed position are provided in base plate 21.

According to the invention, the second locking means include a push-piece 24 arranged to be moved in a longitudinal direction of the strand, in response to an action of the user, between a first rest position in which cap 22 is locked in a closed position on base plate 21, and a second pushed-in position in which cap 22 is unlocked from base plate 21.

As a result of these different aspects of the invention, there is provided a clasp of simple design for adjusting the length of a bracelet strand or belt.

Of course, the present invention is not limited to the illustrated example and is capable of various variants and modifications that will appear to those skilled in the art.

LIST OF PARTS

1. First strip
10. Bar
11. Attachment link
100. First strand
101. Second strand
2. Second strip
20. Securing member
200. Receptacle
21. Base plate
210. Guide slots
211. Guide cylinder
212. Screw
213. Hollow
22. Cap
220. Lateral walls
221. L-shaped grooves
230. Springs
24. Push-piece
240. Push-piece body
241. Push-piece arm
242. Slugs
243. Through holes
25. Central orifice
26,27. Longitudinal recesses
3. Third strip
30. Upper stud
31. Lower stud
32. Spring catch

The invention claimed is:

1. A bracelet clasp, comprising:

at least first and second strips, the first strip being hinged to the second strip by a first end, between a closed position, in which the first strip is folded onto the second strip, and an open position, in which a second end of the first strip is distant from the second strip, the first strip carrying, at the second end, a securing member to secure a first bracelet strand of a bracelet, a second bracelet strand of the bracelet being at least indirectly connected to the second strip, and the second strip comprising a first locking mechanism to hold the first strip in the closed position, the securing member comprising an adjustment mechanism to adjust a useful length of the bracelet, said adjustment mechanism comprising:

a base plate secured to the second end of the first strip, a cap pivotally hinged to the base plate, the first bracelet strand passing between the base plate and the cap and being held by a holding mechanism, and a second locking mechanism to lock the cap in a closed position on the base plate, and wherein the second locking mechanism comprises a push-piece arranged to be moved in a longitudinal direction of the bracelet along which the length of the bracelet is adjustable with the adjustment mechanism, in response to an action of a user, between a first rest position in which the cap is locked in the closed position on the base plate, and a second pushed-in position in which the cap is unlocked from the base plate.

2. The clasp according to claim 1, wherein the cap has an L-shaped groove on an inner face of at least one lateral wall thereof, in proximity to one end thereof.

3. The clasp according to claim 1, wherein the push-piece includes a slug on at least one edge thereof, the slug being configured to cooperate with a corresponding L-shaped groove.

4. The clasp according to claim 1, wherein the second locking mechanism includes a return mechanism configured to cooperate with the push-piece so as to hold the push-piece in the closed position.

5. The clasp according to claim 4, wherein said return mechanism includes at least one spring.

6. The clasp according to claim 4, wherein the base plate comprises a guide to guide the push-piece, and the return mechanism rests in the guide.

7. The clasp according to claim 1, wherein the base plate comprises a guide to guide the push-piece.

8. The clasp according to claim 1, wherein the holding mechanism includes a stud, the base plate has the stud on an upper face thereof, and the stud is insertable in a suitable hole of the first bracelet strand to define an anchoring point.

9. The clasp according to claim 1, wherein the first bracelet strand is inserted through the adjustment mechanism from a side of the adjustment mechanism where the cap is hinged on the base plate.

10. A wristwatch comprising the bracelet provided with the clasp according to claim 1.

11. A module for securing a strand of a bracelet to a fastener, comprising:

an adjustment mechanism to adjust a length of the strand, the adjustment mechanism comprising:

a base plate, a cap pivotally hinged to the base plate, the strand passing between the base plate and the cap and being held by a holding mechanism, and a locking mechanism to lock the cap on the base plate in a closed position is provided in the base plate, and wherein the locking mechanism includes a push-piece arranged to be moved in a longitudinal direction of the bracelet along which the length of the strand is adjustable with the adjustment mechanism, in response to an action of a user, between a first rest position in which the cap is locked in the closed position on the base plate, and a second pushed-in position in which the cap is unlocked from the base plate.

12. A bracelet clasp, comprising:

at least first and second strips, the first strip being hinged to the second strip by a first end, between a closed position, in which the first strip is folded onto the second strip, and an open position, in which a second end of the first strip is distant from the second strip, the first strip carrying, at the second end, a securing member to secure a first bracelet strand of a bracelet, a second bracelet strand of the bracelet being at least indirectly connected to the second strip, and the second strip comprising a first locking mechanism to hold the first strip in the closed position, the securing member comprising an adjustment mechanism to adjust a useful length of the bracelet, said adjustment mechanism comprising:

a base plate secured to the second end of the first strip, a cap pivotally hinged to the base plate, the first bracelet strand passing between the base plate and the cap and being held by a holding mechanism, and a second locking mechanism to lock the cap in a closed position on the base plate, wherein the second locking mechanism comprises a push-piece arranged to be moved in a longitudinal direction of the bracelet, in response to an action of a user, between a first rest position in which the cap is locked in the closed position on the base plate, and a second pushed-in position in which the cap is unlocked from the base plate, and wherein the base plate comprises a guide to guide the push-piece.

13. The clasp according to claim 12, wherein the cap has an L-shaped groove on an inner face of at least one lateral wall thereof, in proximity to one end thereof.

14. The clasp according to claim 12, wherein the push-piece includes a slug on at least one edge thereof, the slug being configured to cooperate with a corresponding L-shaped groove.

15. The clasp according to claim 12, wherein the second locking mechanism includes a return mechanism configured to cooperate with the push-piece so as to hold the push-piece in the closed position.

16. The clasp according to claim 15, wherein said return mechanism includes at least one spring.

17. The clasp according to claim 15, wherein he return mechanism rests in the guide.

18. The clasp according to claim 12, wherein the holding mechanism includes a stud, the base plate has the stud on an upper face thereof, and the stud is insertable in a suitable hole of the first bracelet strand to define an anchoring point.

19. The clasp according to claim 12, wherein the first bracelet strand is inserted through the adjustment mechanism from a side of the adjustment mechanism where the cap is hinged on the base plate.

20. A wristwatch comprising the bracelet provided with the clasp according to claim 12.

* * * * *